US005473414A

United States Patent [19]

Thompson

[11] Patent Number: 5,473,414

[45] Date of Patent: Dec. 5, 1995

[54] CLEANING COMMUTATOR BRUSHES FOR AN ELECTRODED DONOR ROLL

[75] Inventor: Michael D. Thompson, Rochester, N.Y.

[73] Assignee: Xerox Corporation, Stamford, Conn.

[21] Appl. No.: 358,510

[22] Filed: Dec. 19, 1994

[51] Int. Cl.[6] ..... G03G 21/00

[52] U.S. Cl. ..... 355/200; 355/259; 355/245; 15/256.51

[58] Field of Search ..... 15/256.51; 355/259, 355/245, 200; 310/248, 249

[56] References Cited

U.S. PATENT DOCUMENTS

| | | | |
|---|---|---|---|
| 3,766,593 | 10/1973 | Becker et al. | 15/308 |
| 3,996,892 | 12/1976 | Parker et al. | 118/658 |
| 4,078,929 | 3/1978 | Gundlach | 96/1.2 |
| 4,568,955 | 2/1986 | Hosoya et al. | 346/153.1 |
| 4,868,600 | 9/1989 | Hays et al. | 355/259 |
| 5,010,367 | 4/1991 | Hays | 355/247 |
| 5,031,570 | 7/1991 | Hays et al. | 118/654 |
| 5,139,862 | 8/1992 | Swift et al. | 310/249 X |
| 5,172,170 | 12/1992 | Hays et al. | 355/259 |
| 5,177,529 | 1/1993 | Schroll et al. | 355/200 |
| 5,291,246 | 3/1994 | Tsukamoto | 355/210 |
| 5,410,386 | 4/1995 | Swift et al. | 355/200 |

*Primary Examiner*—R. L. Moses

[57] ABSTRACT

A self-cleaning commutator brush structure for use with electroded donor members. The donor member is provided with embedded electrodes to which an electrical bias is supplied for creating toner clouding in the development zone of a toner imaging system. Electrical power is supplied to the electrodes via a pair of commutator brushes which contact the electrodes. A pair of bumps positioned at different locations on one of the surfaces of the donor member impede movement of the brushes. Each time the donor member is moved through a complete cycle of movement each brush is caused to be flicked by the bump to thereby liberate toner therefrom. The flicking action and consequent toner liberation serve to keep the interface between the brushes and the electrodes clean which prevents electrical resistance buildup therebetween.

16 Claims, 3 Drawing Sheets

CLEANING COMMUTATOR BRUSHES FOR AN ELECTRODED DONOR ROLL

BACKGROUND OF THE INVENTION

This invention relates generally to the rendering of latent electrostatic images visible. More particularly, the invention relates to non-interactive or scavengeless development systems and a self-cleaning commutating structure for transmitting electrical power to electrodes of a toner donor roll.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves latent charge patterns on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

Low scavenging, high quality, low noise, powder xerographic development is important for a number of reasons. The high quality low noise operation is, of course, desirable for any development system but the low scavenging behavior is if particular importance for single pass process color and highlight color applications. Low scavenging development can be achieved by applying an AC/DC bias to one or more wires which are self spaced over a toned donor roll as disclosed in U.S Pat. No. 4,868,600 granted to Hays et al on Sep. 19, 1989. Excitation of the toner layer on the donor roll causes a charged toner cloud to form from which toner can be developed to an electrostatic latent image. The is a very effective way to achieve low scavenging development but there are problems in doing so reliably using this approach, Wire vibration has been seen to cause strobing in the images. Such vibration has been shown to be affected by too much tension in the wires and the presence of toner material. Streaks in images are seen to occur when debris gets caught between the wire and the donor roll.

Another approach which achieves low scavenging development is the use of a donor roll with an embedded electrode structure of the type disclosed in U.S. Pat. No. 5,172,170 granted to Hayset al on Dec. 15, 1992. These electrodes lie parallel to the longitudinal axis of the donor roll and are embedded in the surface of the donor roll. These electrodes or conducting strips are excited using a combination AC/DC electrical bias which causes the charged toner on the surface of the donor roll to form a cloud of toner in the manner similar to the method using the self-spaced wire or wires.

The AC bias must be transmitted to the embedded electrodes from one or both ends of the roll. One way to transmit this bias to the electrodes is via a conductive brush contact through exposed electrodes at one end of the roll. In the case of interdigitated electrode structures, brush contact is made at both ends of the roll. Toner from the development process can get caught in the brush thereby causing causing a high resistance at the interface between the electrode and contact brush. Eventually such a condition causes failure of the toner jumping process due to the inability to transmit high enough potentials to the electrodes on the donor roll surface.

The invention is particularly useful in highlight color imaging such as tri-level imaging. The concept of tri-level, highlight color xerography is described in U.S Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught in the '929 patent, the xerographic contrast on the charge retentive surface or photoreceptor is divided into three levels, rather than two levels as is the case in conventional xerography. The photoreceptor is charged, typically to −900 volts. It is exposed imagewise, such that one image corresponding to charged image areas (which are subsequently developed by charged-area development, i.e. CAD) stays at the full photoreceptor potential ($V_{cad}$ or $V_{ddp}$). The other image is exposed to discharge the photoreceptor to its residual potential, i.e. $V_{dad}$ or $V_c$ (typically −100 volts) which corresponds to discharged area images that are subsequently developed by discharged-area development (DAD) and the background areas exposed such as to reduce the photoreceptor potential to halfway between the $V_{cad}$ and $V_{dad}$ potentials, (typically −500 volts) and is referred to as $V_{white}$ or $V_w$. The CAD developer is typically biased about 100 volts closer to $V_{cad}$ than $V_{white}$ (about −600 volts), and the DAD developer system is biased about 100 volts closer to $V_{dad}$ than $V_{white}$ (about −400 volts).

The viability of printing system concepts such as tri-level, highlight color xerography requires development systems that do not scavenge or interact with a previously toned image. Since commercial development systems such as conventional magnetic brush development and jumping single component development interact with the image receiver, a previously toned image will be scavenged by subsequent development. Since the present commercial development systems are highly interactive with the image bearing member, there is a need for scavengeless or non-interactive development systems.

The present invention is especially suited for use in hybrid scavengeless single component development (SCD) systems wherein a confined toner cloud is formed in a 250 micron development zone gap by applying an AC bias of several hundred volts to one or more small diameter wire electrodes carried by a toner donor roll positioned adjacent a photoreceptor. The AC bias, which has a frequency is in the kilohertz range, acts upon the charged toner to induce a mechanical agitation which is sufficient to overcome adhesive forces that hold toner to the donor roll. Once freed, the toner is readily available to develop the electrostatic latent image on the photoreceptor. Toner delivery in a hybrid system differs from conventional SCD systems, in that, toner is delivered to a donor roll via a magnetic brush loader.

In earlier renderings of this type of development system, the electrodes consisted of taut wires supported intermediate a photoreceptor and a toner donor roll. See for example U.S. Pat. No. 5,010,367 granted to Dan A. Hays on Apr. 23, 1991. Unfortunately, it has proven difficult to devise a mechanical design for the fragile taut wire array that is both robust, and free of development artifacts. For example, the wires tend to entrap toner agglomerates and spurious paper fibers which can cause streaks in the developed image.

The problems attendant taut wires may be obviated by using an array of small diameter wires or electrodes embedded in the surface of the donor roll. In this approach, the AC bias is applied to the wires in the development zone through commutating brushes at the ends of the donor roll. Such a construction is described in U.S. Pat. No. 3,996,892 granted to Parker et al on Dec. 14, 1976. The '892 granted to Parker et al on Dec. 14, 1976 discloses a spatially programmable electroded donor roll wherein an DC voltage is applied to the wire electrodes in the development nip or zone, pre-nip and post-nip zones through commutating brushes at the ends of the donor roll. Such an arrangement allows the bias profile around the circumference of a two component magnetic brush development roll to be tailored in a way that promotes good development. Thus, a pre-nip voltage of 100 volts, a nip voltage of 250 to 300 volts and a post-nip voltage of 1000 volts are provided. The electrodes on the donor roll were constructed by first plating a thin layer of copper on the outer surface a phenolic roll, and then by etching 0.01" wide electrode strips, on 0.02 centers, axially along the length of the roll. Next, the roll was overcoated with a semi-conductive rubber sheath, except for a short length at the ends where the bias was applied to the electrodes through a commutating bushes. The voltage profile around the circumference of the roll was determined by the IR voltage drop due to current flow through the semi-conductive sheath from one commutator to another. Such a construction is know to have had problems with wear and pitting of the thin electrodes where they made contact with the commutating brushes. Nickel plating the electrodes helped alleviate the wear problem somewhat, but the electrode damage problem was never completely solved.

The '892 patent, in a second embodiment, discloses the use of a ring-like resistive member mounted for rotation with a donor roll. A plurality of stationarily mounted electrical contacts ride on the ring-like member which, in turn, is seated on the coating free portions of conductors and mounted for rotation with a sleeve upon which the conductors are carried.

U.S. Pat. No. 4,568,955 granted to Hosoya also discloses a development or donor roll having electrode structures incorporated therein. Copper electrode structures are deposited on the insulated surface of a donor roll. In one rotational position of the Hosoya et al donor roll, a DC voltage is supplied to alternate ones of the copper electrodes while an AC voltage is supplied to the electrodes intermediate the electrodes having the DC voltage applied thereto. In another rotational position of this donor roll the AC and DC voltages are applied to the opposite electrodes. In other words, each electrode when positioned in the development nip first has one kind of voltage applied and then the other. The AC voltage establishes an alternating electric field for liberating toner particles on the surface of the donor roll. According to the Hosoya et al description, when the AC voltage is greater than the DC voltage the toner particles move from one electrode to an adjacent electrode and when the AC voltage is less than the DC voltage the toner particles move in the opposite direction between two adjacent electrodes.

U.S. Pat. No. 5,031,570 granted to Hays et al on Jul. 16, 1991 and assigned to the same assignee as the instant application discloses a scavengeless development system for use in highlight color imaging. AC biased electrodes positioned in close proximity to a magnetic brush structure carrying a two-component developer cause a controlled cloud of toner to be generated which non-interactively develops an electrostatic image. The two-component developer includes mixture of carrier beads and toner particles. By making the two-component developer magnetically tractable, the developer is transported to the development zone as in conventional magnetic brush development where the development roll or shell of the magnetic brush structure rotates about stationary magnets positioned inside the shell.

U.S. Pat. No. 4,868,600 granted to Hays et al on Sep. 19, 1989 discloses a scavengeless development system in which toner detachment from a donor and the concomitant generation of a controlled powder cloud is obtained by AC electric fields supplied by self-spaced electrode structures positioned within a development nip. The electrode structure is placed in close proximity to the toned donor within the gap or nip between the toned donor and image receiver, self-spacing being effected via the toner on the donor. Such spacing enables the creation of relatively large electrostatic fields without risk of air breakdown.

U.S. Pat. No. 5,010,367 granted to Dan A. Hays on Apr. 23, 1991 discloses a scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a toner cloud and position one end of the cloud in close proximity to the image receiver for optimum development of lines and solid areas without scavenging a previously toned image.

U.S. patent application Ser. No. 07/724,242 filed on Jul. 1, 1991 in the name of Dan A. Hays and assigned to the same assignee as the instant application discloses a scavengeless or non-interactive development system for use in image formation such as highlight color imaging. A toned donor roll structure having two sets of interdigitated electrodes physically supported by an insulative support structure is provided. Both sets of electrodes have a DE bias applied thereto while the other set has an AC bias applied thereto. The AC and DC biases are such as to preclude background development without creating fringe DC fields between adjacent electrodes.

U.S. Pat. No. 5,172,170 granted to Hays et al on Dec. 12, 1992 relates to an apparatus in which a donor roll advances toner to an electrostatic latent image recorded on a photoconductive member. A plurality of electrical conductors are located in grooves in the donor roll. The electrical conductors are spaced from one another and adapted to be electrically biased in the development zone to detach toner from the donor roll so as to form a toner cloud in the development zone. In the development zone, toner is attracted from the toner cloud to the latent image. In this way, the latent image is developed with toner.

It is known in the prior art, as illustrated in U.S. Pat. No. 3,766,593 granted to Becker et al on Oct. 23, 1973, to clean residual particulate material remaining after transfer of a developed image from an insulator. As disclosed in the '593 patent, the cleaning apparatus comprises rotating and stationary brushes for cleaning both surfaces of the insulator, both brushes enmeshing after the cleaning cycle to provide a brush self-cleaning action for the stationary brush. The apparatus is designed such that air flow is at a maximum at the point where the particulate material would normally be centrifuged out of the brush housing, thereby minimizing leakage of the particulate material despite a gap between the insulator and the brush housing.

BRIEF SUMMARY OF THE INVENTION

In accordance with the present invention, a commutator brush structure and the interface between the brush structure and a donor roll structure are kept free of toner particles in order to avoid the build up of a high electrical resistance between the brush and the electrodes carried by the donor roll. To this end, a pair of bumps are provided either on the surface of the donor roll or on its end. The bumps or protrusions serve as flicker members for a pair of commutator brushes. For each revolution of the donor roll, each brush is lifted out of contact with the electrodes on the donor roll. The bumps are angularly staggered such that only one brush is out of contact with the donor electrodes at any given time. The bristles bend due to their engagement with the bumps but return quickly via their natural restoring force. Each brush cleans the area of contact with the electrodes and is detoned by the flicking action effected by the bumps.

DETAILED DESCRIPTION OF THE PREFERRED EMBODIMENT OF THE INVENTION

Figure 5:
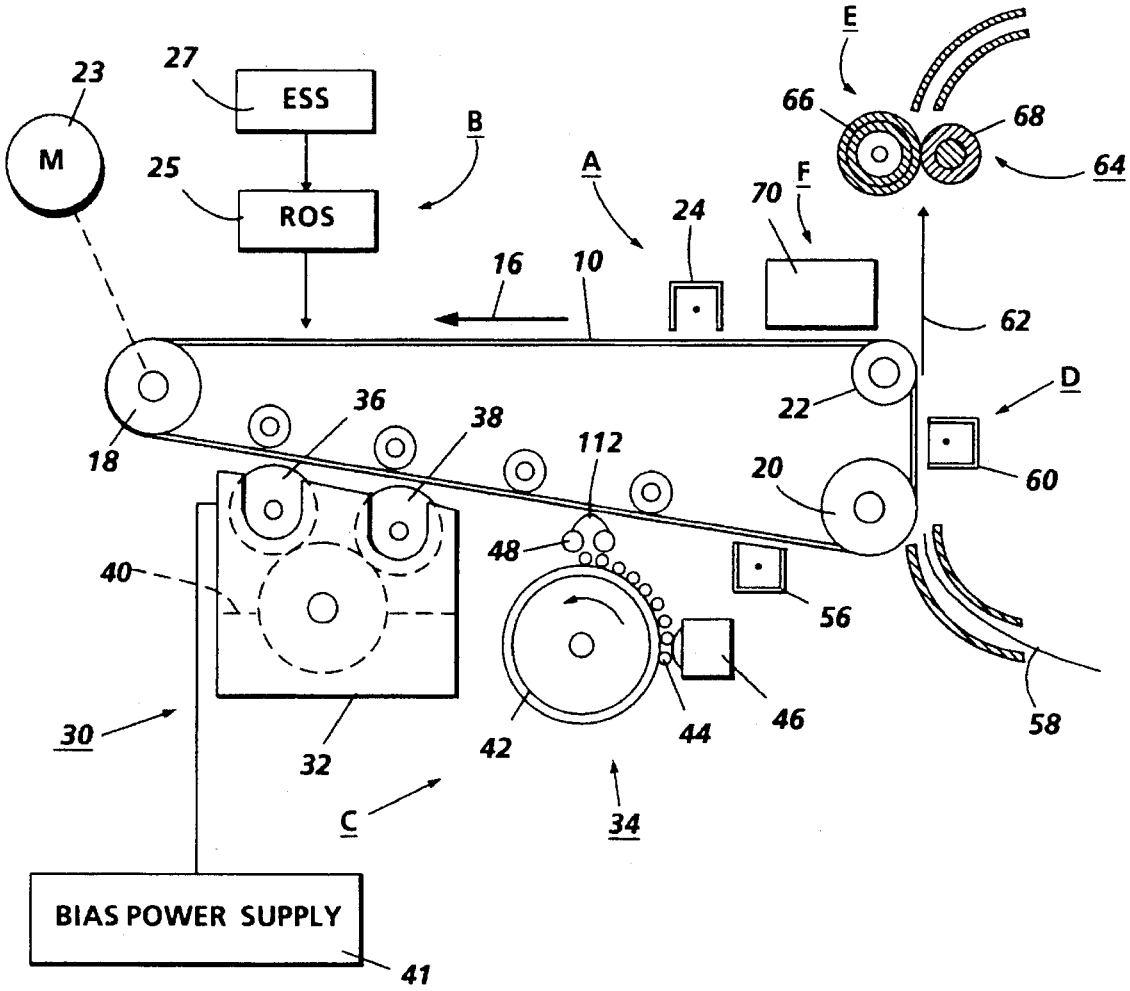
PRIOR ART FIG. 5
FIG. 5 is schematic illustration of a printing apparatus of the prior art in which the present invention may be utilized.

As shown in FIG. 5, a highlight color printing machine of the prior art in which the invention may be utilized comprises a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 5, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 27 provides for control of the ROS as well as other subassemblies of the machine.

The photoreceptor, which is initially charged to a voltage $V_0$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. The photoreceptor is also discharged to $V_w$ equal to approximately −500 volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$. The developer material 40 by way of example contains color toner and magnetic carrier beads. Appropriate electrical biasing of the developer housing is accomplished via power supply 41 electrically connected to developer apparatus 32. A DC bias of approximately −400 volts is applied to the rollers 36 and 38 via the power supply 41. With the foregoing bias voltage applied and the color toner suitably charged, discharged area development (DAD) with colored toner is effected.

Figure 3:
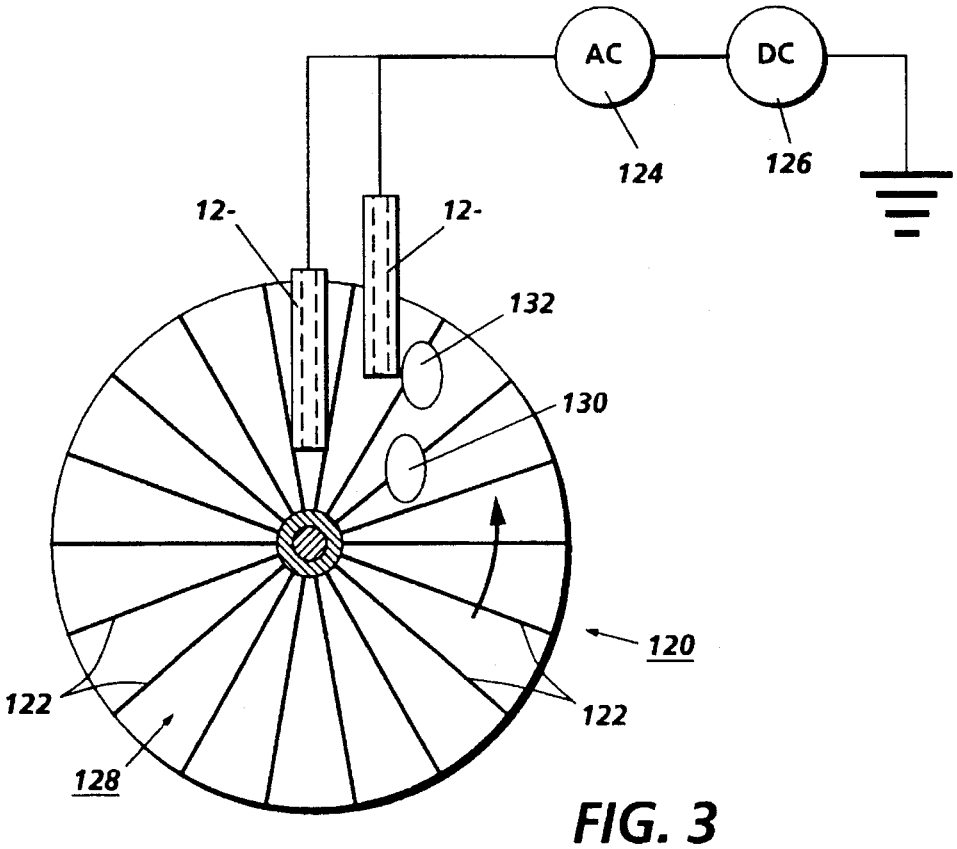
FIG. 3 is a schematic view of the end of another electroded donor structure and brush commutator for developing toner images.
Figure 2:
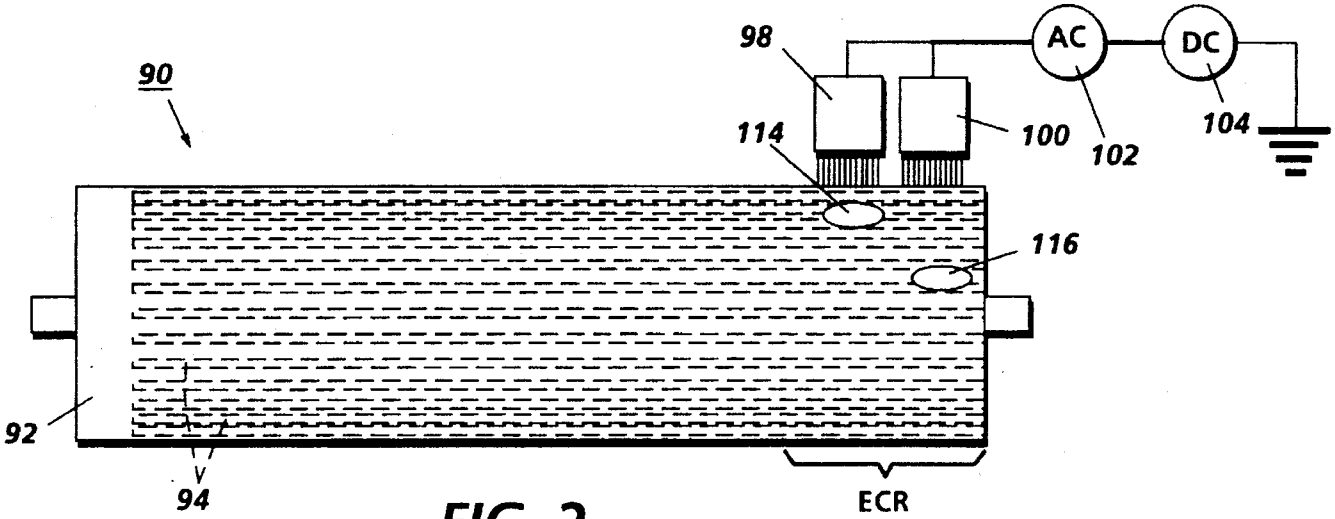
FIG. 2 is a front view of the device illustrated in FIG. 1.

The second developer apparatus 34 comprises a donor roll structure in the form of a roller 42. The donor structure 42 conveys developer 44, which in this case is a single component developer comprising black toner deposited thereon via a combination metering and charging device 46, to an area adjacent an electrode structure. The toner metering and charging can also be provided by a two component developer system such as a magnetic brush development structure. The donor structure can be rotated in either the 'with' or 'against' direction vis-a-vis the direction of motion of the charge retentive surface. The donor roller 42 is preferably coated with TEFLON-S (trademark of E.I. DuPont De Nemours) or anodized aluminum or a polycabonate coating with a suitable additive to enable charge to relax through the coating. The donor roll structure 42 is provided with a plurality of embedded electrodes 44. (FIGS. 2 and 3). A DC biased AC power source 46 serves to supply a suitable electrical bias to the electrodes 44 via a pair of commutator brushes 48 and 50. The brushes are supported relative to the donor roll 42 such that they contact some of the embedded electrodes as the electrodes pass through a development zone 52 (FIG. 5). The purpose of applying an electrical bias to the electrodes in the development zone is to liberate toner from the surface of the donor roll for development of latent images on the photoreceptor. For a more detailed description of an electroded donor roll structure reference may be had to '170 patent noted above. A pair of protrusions or bumps 55, 56 on the circumference of the donor roll interfere with the engagement of the commutator brushes 48 and 50 once for each revolution of the donor roll. The bumps are positioned or staggered such that when one section of brush is out of contact with the electrodes, i.e. being cleaned, the other brush section will still be supplying a voltage to the development zone.

A sheet of support material 58 (Figure FIG. 5) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 68 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing 70 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 1:
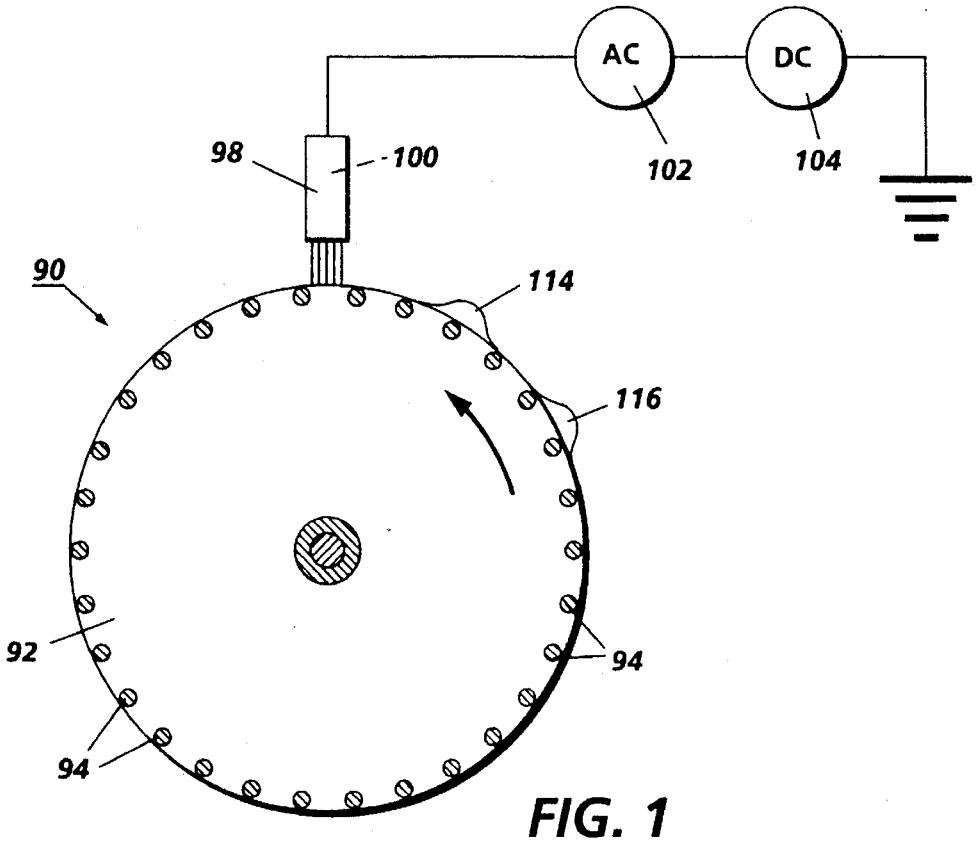
FIG. 1 is a schematic view of the end of an electroded donor structure and brush commutator for developing toner images.

A donor roll structure 90 directed to the features of this invention is illustrated in FIG. 1. The donor roll structure is preferably used in place of the donor structure 34 illustrated in FIG. 5. As illustrated in FIGS. 1 and 2, the donor roll structure 90 comprises a roll structure 92 having a plurality of electrodes 94 embedded in a surface 96 thereof. A pair of commutator brushes 98 and 100 (FIG. 2) are provided for applying a suitable electrical potential to the electrodes 94. To this end, an AC power source 102 biased by a DC power source 104 is provided for applying an alternating current to the electrodes. The applied AC serves to cause toner particles to be liberated form the surface of the donor roll in a development zone 112 intermediate the photoconductive belt 10 and the donor roll structure 90.

In order to obviate the problem of electrical resistance build up between the brushes and the electrodes and the brushes, which build up is due to toner accumulation in the brushes, means for causing a periodic flicking action of the brush bristles is provided. Accordingly, a pair of bumps or protrusions 114 and 116 are carried by the surface 96. As can be seen from FIG. 2, the bumps or protrusions are positioned in a staggered relationship vis-a-vis the surface 96. As the donor roll structure 90 is rotated the brushes 98 is first contacts the bump 114 thereby causing a flicking action of the brush bristles which liberates toner particles therefrom. Similarly, a flicking action of the brush bristles 100 is effected through contact thereof with the bump or protrusion 116. Since a brush's bristles are out of contact with the electrodes when engaging its respective bump, the staggered relationship of the bumps or protrusions ensures continuous commutation of electrical power to the electrodes.

Figure 4:
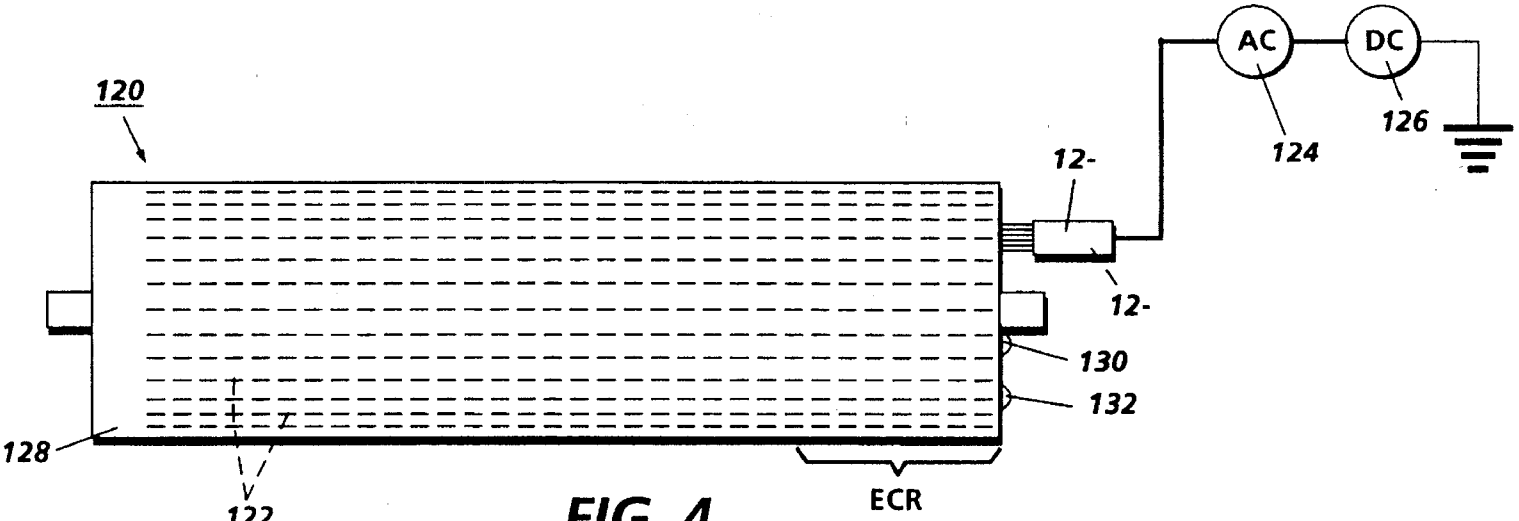
FIG. 4 is a front view of the device illustrated in FIG. 3.

A modified embodiment of the donor structure 90 is illustrated in FIGS. 3 and 4 comprises a donor roll structure 120. The donor structure 120 is provided with a plurality of embedded electrodes 122. A pair of commutator brushes 124 and 126 are similar to brushes 98 and 100 but they contact their associated electrodes 122 at an end 128 of the donor structure 120 in lieu of contacting electrodes on a surface such as in the case of the embodiment disclosed in FIGS. 1 and 2. A pair of bumps or protrusions 130 and 132 similar to bumps 1114 and 116 are integral with the end 128 of the donor roll structure. An electrical potential is applied to the brushes 124 and 126 via AC power source 134 biased via DC power source. Toner liberated through the action of the flicking the brush commutators is carried away from the area of the brushes and their contact with the bumps or protrusions by means of a vacuum source and plenum, not shown.

What is claimed is:

1. Electroded donor apparatus for presenting toner particles to electrostatic images, said apparatus comprising:

an electroded donor member having and endless surface;

a stationary commutator brush structure including a plurality of electrically conductive fiber bristles;

means supporting said bristles for contact with electrodes carried by said donor member;

means for periodically removing toner particles from said bristles.

2. Apparatus according to claim 1 wherein said means for removing toner particle comprises means for causing a flicking action of said bristles.

3. Apparatus according to claim 2 wherein said brush structure comprises a pair of brushes.

4. Apparatus according to claim 3 wherein said means for periodically displacing said bristles comprises a pair of bumps angularly displaced on a surface of said donor member such that one or the other of said pair of brushes is always in contact with electrodes carried by said electroded donor member.

5. Apparatus according to claim 4 wherein said bumps are carried by the same surface as said electrodes.

6. Apparatus according to claim 5 wherein said bumps are carried by said endless surface.

7. Apparatus according to claim 5 wherein said electroded donor member comprises a roll structure.

8. Apparatus according to claim 5 wherein said bumps are carried on an end of said roll structure.

9. A method of presenting toner particles to electrostatic images, said method including the steps of:

rotating an electroded donor member having and endless surface;

contacting said donor member with a stationary commutator brush structure including a plurality of electrically conductive fiber bristles;

supporting said bristles for contact with electrodes carried by said donor member;

periodically removing toner particles from said bristles.

10. The method according to claim 9 wherein said means for removing toner particle comprises means for causing a flicking action of said bristles.

11. The method according to claim 10 wherein said brush structure comprises a pair of brushes.

12. The method according to claim 11 wherein said means for periodically displacing said bristles comprises a pair of bumps, said bumps being angularly displaced on a surface of said donor member such that one or the other of said pair of brushes is always in contact with electrodes carried by said electroded donor member.

13. The method according to claim 12 wherein said bumps are carried by the same surface as said electrodes.

14. The method according to claim 13 wherein said bumps are carried by said endless surface.

15. The method according to claim 13 wherein said electroded donor member comprises a roll structure.

16. The method according to claim 13 wherein said bumps are carried on an end of said roll structure.

* * * * *